US006171751B1

(12) United States Patent
Mourey et al.

(10) Patent No.: US 6,171,751 B1
(45) **Date of Patent: *Jan. 9, 2001**

(54) IMAGING ELEMENT WITH HINDERED AMINE STABILIZER IN THE BASE

(75) Inventors: Thomas H. Mourey, Rochester; Peter T. Aylward, Hilton; William A. Mruk, Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/141,181

(22) Filed: Aug. 27, 1998

(51) Int. Cl.[7] ..... G03C 1/79; G03C 1/795; G03C 8/52

(52) U.S. Cl. ..... 430/201; 430/212; 430/536; 430/538; 430/551; 347/106; 428/513; 524/99

(58) Field of Search ..... 430/536, 535, 430/201, 538, 551, 212; 428/513; 347/106; 524/99

(56) References Cited

U.S. PATENT DOCUMENTS

| | | | | |
|---|---|---|---|---|
| 4,283,486 | | 8/1981 | Aono et al. | 430/538 |
| 4,352,861 | * | 10/1982 | von Meer et al. | 430/538 |
| 4,377,616 | | 3/1983 | Ashcraft et al. | 428/213 |
| 4,562,145 | | 12/1985 | Woodward et al. | 430/538 |
| 4,582,785 | | 4/1986 | Woodward et al. | 430/538 |
| 4,632,869 | | 12/1986 | Park et al. | 428/315 |
| 4,758,462 | | 7/1988 | Park et al. | 428/213 |
| 5,055,371 | | 10/1991 | Lee et al. | 430/126 |
| 5,100,862 | | 3/1992 | Harrison et al. | 503/227 |
| 5,141,685 | | 8/1992 | Maier et al. | 264/45.3 |
| 5,244,861 | | 9/1993 | Campbell et al. | 430/201 |
| 5,514,460 | | 5/1996 | Surman et al. | 428/304.4 |
| 5,866,282 | * | 2/1999 | Bourdelais et al. | 430/538 |

FOREIGN PATENT DOCUMENTS

| | | |
|---|---|---|
| 0 803 377 A1 | 10/1997 | (EP) . |
| WO 93/04400 | 3/1993 | (WO) . |

OTHER PUBLICATIONS

"Antioxidants", Ciba–Geigy Co., 1995, Basel Switzerland.*
Holtzen, "Polyolefin discoloration", *Plastics Compounding* Nov./Dec. 1991.*

* cited by examiner

*Primary Examiner*—Richard L. Schilling
(74) *Attorney, Agent, or Firm*—Paul A. Leipold

(57) ABSTRACT

The invention relates to a laminated base for an imaging element comprising a paper having adhered to each side a biaxially oriented sheet of polyolefin polymer, wherein the top biaxially oriented sheet on the image side has incorporated therein a stabilizing amount of hindered amine light stabilizer.

11 Claims, No Drawings

IMAGING ELEMENT WITH HINDERED AMINE STABILIZER IN THE BASE

FIELD OF THE INVENTION

This invention relates to the formation of a laminated substrate for imaging materials. It particularly relates to improved substrates for photographic materials.

BACKGROUND OF THE INVENTION

Imaging paper, particularly photographic imaging paper, requires materials in the image substrate that provide long-term survivability and stability during both display and storage. These properties are most desirable and have significant commercial value.

It has been proposed in U.S. Pat. No. 5,244,861 to utilize biaxially oriented polypropylene sheets laminated to cellulose photographic paper for use as a reflective receiver for the thermal dye transfer imaging process. In the formation of biaxially oriented sheets described in U.S. Pat. No. 5,244,861, a coextruded layer of polypropylene is cast against a water cooled roller and quenched by either immersion in a water bath or by cooling the melt by circulating chill liquid internal to the chill roll. The sheet is then oriented in the machine direction and in the transverse direction. While a variety of materials may be used to create a biaxially oriented sheet, one of the preferred materials is polypropylene because of its strength and processing properties during the orientation. In addition, the low cost of this material makes it attractive to use.

In U.S. application Ser. No. 08/862,708 filed May 23, 1997, it has been proposed to use biaxially oriented polyolefin sheets laminated to photographic grade paper as a photographic support for silver halide imaging systems. In U.S. application Ser. No. 08/862,708 filed May 23, 1997, advantages including increased opacity, improved tear resistance, and reduced substrate curl are obtained by the use of high strength biaxially oriented polyolefin sheets. The above advantages of biaxially oriented polypropylene layers are realized when an opacifying pigment is located in at least one layer of polypropylene, which may be solid or voided. Either the rutile or anatase crystalline form of titanium dioxide ($TiO_2$) is commonly used for opacity, whiteness, image sharpness, and control of pearlescence.

Polypropylene is inherently more susceptible to chemical degradation that leads to loss of mechanical properties. It undergoes thermal degradation during processing such as extrusion of thin films, and photooxidative degradation with long-term exposure to light. $TiO_2$ catalyzes and accelerates both thermal and photooxidative degradation. In the art of resin coating photographic papers and also in the thermal processing of biaxially oriented polyolefins sheets, the melt polymers are extruded at high temperatures and are also subjected to high shear forces. These conditions may degrade the polypropylene resin, resulting in resin discoloration and charring, formation of polymer slugs, and formation of lines and streaks in the extruded film from degraded material deposits on die surfaces. Also, thermally degraded polypropylene is less robust than undegraded polymer for long-term stability, and may thereby shorten the life of the print.

Hindered phenol antioxidants are commonly used alone or in combination with secondary antioxidants to stabilize polypropylene during melt processing, but provide little protection from long-term photooxidation. They are also responsible for some forms of oxidative atmospheric gas yellowing in prints stored in the dark. This undesirable color may develop on the print or around the print edge with archival keeping, and has been attributed to colored oxidation products of hindered phenol antioxidants that are formed in the dark with exposure to oxidizing pollutants such as oxides of nitrogen in the presence of white pigments such as $TiO_2$.

In U.S. Pat. No. 4,582,785 it is suggested that polymeric hindered amines, when added to polyethylene coated photographic paper, can improve their photostability. In this patent a polymeric hindered amine is claimed as the sole stabilizer for both thermal processing and light stability in a single layer of a polymeric material, polyethylene, that is inherently more stable than polypropylene to degradation. Photostabilizers such as the polymeric hindered amine improve the archival qualities of the resin layer by eliminating the phenolic antioxidant yellowing and preventing photo-degradation; however, while hindered amines provide adequate stabilzation of polyethyelene, they do not stabilize polypropylene significantly during extrusion, thereby severely limiting the latitude of processing conditions. The desired stabilizer package would contain both a hindered phenol for protection during extrusion, and a hindered amine light stabilizer for long-term photo stability. Unfortunately, the use of hindered phenols and hindered amine light stabilizers in a monolayer white imaging element is unacceptable because hindered amine light stabilizers worsen phenolic antioxidant discoloration.

There remains a need to provide an imaging support that contains a biaxially oriented, pigmented polyolefin sheet that is extrusion processable without degradation of polypropylene resin. In addition it must have exceptional long-term resistance to degradation and embrittlement when exposed to light and other environmental stresses, while providing an imaging support that has exceptional dark stability and prevents discoloration during dark keeping. The chemistry to achieve thermal processability and to maximize the life of images for light stability and dark keeping may require synergistic effects from more than one additive.

PROBLEM TO BE SOLVED BY THE INVENTION

There is a need for imaging materials that better resist turning yellow and becoming brittle with age.

SUMMARY OF THE INVENTION

An object of the invention is to provide improved imaging materials.

A further object is to provide improved imaging support.

A further object is to provide a base for images that will have improved resistance to polymer degradation with long-term exposure to light.

Another object is to provide an imaging material that has improved dark keeping, and in particular, does not significantly discolor with long-term dark keeping.

These and other objects of the invention generally are accomplished by providing a laminated base for an imaging element comprising a paper having adhered to each side a biaxially oriented sheet of polyolefin polymer, wherein the top biaxially oriented sheet on the image side has incorporated therein a stabilizing amount of hindered amine light stabilizer.

ADVANTAGEOUS EFFECT OF THE INVENTION

The invention provides an improved base for photosensitive layers and other image receiving layers. It particularly provides an improved base for color photographic materials that require long-term stability to light and dark keeping conditions. The advantage of this invention is that by using a hindered amine light stabilizer in a biaxially oriented polyolefin sheet, the rate of photo-oxidative degradation of the imaging support can be significantly reduced. Another advantage is that by reducing the degradation process, the imaging support does not embrittle over the life of the print and the life of the print is prolonged compared to nonhindered amine resin coated imaging supports. An additional advantage that is that the dark keeping properties are further improved by preventing dark keep yellowing of phenolic antioxidants, permitting the use of the latter antioxidants as stabilizers during thermal processing.

DETAILED DESCRIPTION OF THE INVENTION

The present invention consists of a multilayer sheet of biaxially oriented polyolefin which is attached to both the top and bottom of a photographic quality paper support by melt extrusion of a polymer tie layer. The biaxially oriented sheets that have been used in this invention contain a plurality of layers in which at least one of the layers contains voids. The voids provide added opacity to the imaging element. This voided layer can also be used in conjunction with a layer that contains at least one pigment from the group consisting of: $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final imaging element.

The present invention consists of a multilayer sheet of biaxially oriented polyolefin which is attached to both the top and bottom of a photographic quality paper support by melt extrusion of a polymer tie layer. The terms as used herein, "top", "upper", "emulsion side", and "face" mean the side or towards the side of an imaging member bearing the imaging layers. The terms "bottom", "lower side", and "back" mean the side or towards the side of the imaging member opposite from the side bearing the imaging layers or developed image. The term "tie layer" as used herein refers to a layer of material that is used to adhere a biaxially oriented sheet to a base such as paper, polyester, fabric, or other suitable material for the viewing of images. The term HALS refers to a hindered amine light stablizer antioxidant.

Any suitable biaxially oriented polyolefin sheet may be used for the sheet on the top side of the laminated base used in the invention. Microvoided composite biaxially oriented sheets are preferred and are conveniently manufactured by coextrusion of the core and surface layers, followed by biaxially orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The total thickness of the composite polyolefin sheet can range from 20 to 150 $\mu$m, preferably from 20 to 70 $\mu$m for good surface smoothness and mechanical properties. Below 15 $\mu$m, the microvoided sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

"Void" is used herein to mean devoid of added solid and liquid matter, although it is likely the "voids" contain gas. The void-initiating particles which remain in the finished packaging sheet core should be from 0.1 to 10 $\mu$m in diameter preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The boids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, is may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula $Ar—C(R)=CH_2$, wherein Ar represents an aromatic hydrocarbon substituent, or an aromatic halohydrocarbon substituent of the benzene series and R is hydrogen or the methyl radical; acrylate-type monomers include monomers of the formula $CH_2=C(R')—C(O)(OR)$ wherein R is selected from the group consisting of hydrogen and an alkyl substituent containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH—COOR$, wherein R is an alkyl substituent containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

Voided layers are more susceptible than solid layers to mechanical failure such as cracking or delamination from adjacent layers. Voided structures that contain $TiO_2$, or are in proximity to layers containing $TiO_2$, are particularly susceptible to loss of mechanical properties and mechanical failure with long-term exposure to light. $TiO_2$ particles initiate and accelerate the photooxidative degradation of polypropylene. By this invention it is shown by the addition of a hindered amine stabilizer to at least one layer of a multilayer biaxially oriented film, in the preferred embodiment in the layers containing $TiO_2$ and, furthermore, in the most preferred embodiment the hindered amine is in the layer with $TiO_2$ as well as in the adjacent layers, that improvements to both light and dark keeping stability are achieved.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix.

For compatibility, an auxiliary layer can be used to promote adhesion of the skin layer to the core. Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The film contains a stabilizing amount of hindered amine at or about 0.01 to 5% by weight in at least one layer of said film. While these levels provide improved stability to the biaxially oriented film, the preferred amount at or about 0.1 to 3% by weight provides an excellent balance between improved stability for both light and dark keeping while making the structure more cost effective.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a typical biaxially oriented, sheet of the invention is as follows:

Solid top skin layer

Core layer

Solid skin layer

The sheet on the side of the base paper opposite to the emulsion layers or image layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated by reference.

The preferred biaxially oriented sheet is a biaxially oriented polyolefin sheet, most preferably a sheet of polyethylene or polypropylene. The thickness of the biaxially oriented sheet should be from 20 to 150 $\mu$m. Below 15 $\mu$m, the sheets may not be thick enough to minimize any inherent non-planarity in the support and would be more difficult to manufacture. At thicknesses higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day. This allows faster emulsion hardening, as the laminated support of this invention greatly slows the rate of water vapor transmission from the emulsion layers during coating of the emulsions on the support. The transmission rate is measured by ASTM F1249.

Suitable classes of thermoplastic polymers for the biaxially and copolymers and mixtures with polyolefins.

Polyolefins are a polymer or copolymer derived from either ethylene or alkyl substituted ethylenes. Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

The biaxially oriented sheet on the backside of the laminated base can be made with layers of the same polymeric material, or it can be made with layers of different polymeric composition. For compatibility, an auxiliary layer can be used to promote adhesion of multiple layers.

Addenda may be added to the biaxially oriented backside sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers, while restraining to some degree the sheet against retraction in both directions of stretching.

The hindered amine light stabilizer (HALS) may come from the common group of hindered amine compounds originating from 2,2,6,6-tetramethylpiperidine, and the term hindered amine light stabilizer is accepted to be used for hindered piperidine analogues. The compounds form stable nitroxyl radicals that interfere with photo-oxidation of polypropylene in the presence of oxygen, thereby affording excellent long-term photostability of the imaging element. The hindered amine will have sufficient molar mass to minimize migration in the final product, will be miscible with polypropylene at the preferred concentrations, and will not impart color to the final product. In the preferred embodiment, examples of HALS include poly[[6-[(1,1,3,3-tetramethylbutyl)amino]-1,3,5-triazine-2,4-diyl][(2,2,6,6-tetramethyl-4-piperidinyl)imino]-1,6-hexanediyl[(2,2,6,6-tetramethyl-4-piperidinyl)imino]] (such as Chimassorb 944 LD/FL), 1,3,5-triazine-2,4,6-triamine, N,N"-1,2-ethanediylbis[N-[3-[[4,6-bis[butyl(1,2,2,6,6-pentamethyl-4-piperidinyl)amino]-1,3,5-triazin-2-yl]methylamino]propyl]-N',N"-dibutyl-N',N"-bis(1,2,2,6,6-pentamethyl-4-piperidinyl)-(such as Chimassorb 119), and propanedioic acid, [[3,5-bis(1,1-dimethylethyl)-4-hydroxyphenyl]methyl] butyl-, bis(1,2,2,6,6-pentamethyl-4-piperidinyl) ester (such as Tinuvin 144), although they are not limited to these compounds.

In addition, the film may contain any of the hindered phenol primary antioxidants commonly used for thermal stabilization of polypropylene, alone or in combination with a secondary antioxidants. Examples of hindered phenol primary antioxidants include benzenepropanoic acid, 3,5-bis(1,1-dimethylethyl)-4-hydroxy-,2,2-bis[[3-[3,5-bis(1,1-dimethylethyl)-4-hydroxyphenyl]-1-oxopropoxy]methyl]-1,3-propanediyl ester (such as Irganox 1010), benzenepropanoic acid, 3,5-bis(1,1-dimethylethyl)-4-hydroxy-, octadecyl ester (such as Irganox 1076), (such as Irganox 1035), phenol, 4,4',4"-[(2,4,6-trimethyl-1,3,5-benzenetriyl)tris(methylene)]tris[2,6-bis(1,1-dimethylethyl)-(such as Irganox 1330), but are not limited to these examples. Secondary antioxidants include organic alkyl and aryl phosphites including examples such as Phosphorous acid, bis[2,4-bis(1,1-dimethylethyl)-6-methylphenyl] ethyl ester (such as Irgafos 38), ethanamine, 2-[[2,4,8,10-tetrakis(1,1-dimethylethyl)dibenzo[d,f][1,3,2]dioxaphosphepin-6-yl]oxy]-N,N-bis[2-[[2,4,8,10-tetrakis(1,1-dimethylethyl)dibenzo[d,f][1,3,2]dioxaphosphepin-6-yl]oxy]ethyl] (such as Irgafos 12), phenol, 2,4-bis(1,1-dimethylethyl)-, phosphite (such as Irgafos 168). A preferred embodiment uses Irgafos 168. The combination of hindered amines with other primary and secondary antioxidants have a synergistic benefit in a multilayer biaxially oriented polymer sheet by providing thermal stability to polymers such as polypropylene during melt processing and extrusion and further enhancing their light and dark keeping properties which is not evident in a mono layer system for imaging products such as photographs. These unexpected results provide for a broader range of polymers that can be utilized in imaging product, thus enabling enhanced features to be incorporated into their design.

The biaxially oriented sheet on the backside of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability, coating polyvinylidene chloride for heat seal properties. Further examples include flame, plasma, or corona discharge treatment to improve printability or adhesion.

The structure of a typical biaxially oriented sheet that may be laminated to the opposite side of the imaging elements is as follows:

treated skin layer solid core layer

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them, followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheets in order to minimize curl in the resulting laminated support. For high humidity applications (>50% RH) and low humidity applications (<20% RH), it is desirable to laminate both a front side and backside film to keep curl to a minimum.

The surface roughness of this invention can also be accomplished by laminating a biaxially oriented sheet to a paper base that has the desired roughness. The roughness of the paper base can be accomplished by any method known in the art such as a heated impression nip or a press felt combined with a roller nip in which the rough surface is part of the press nip. The preferred roughness of the base paper is from 35 $\mu$m to 150 $\mu$m. This preferred range is larger than roughness range for the imaging support because of the loss of roughness that occurs in melt extrusion lamination.

In one preferred embodiment, in order to produce photographic elements with a desirable photographic look and feel, it is preferable to use relatively thick paper supports (e.g., at least 120 $\mu$m thick, preferably from 120 to 250 $\mu$m thick) and relatively thin microvoided composite sheets (e.g., less than 50 $\mu$m thick, preferably from 20 to 50 $\mu$m thick, more preferably from 30 to 50 $\mu$m thick).

As used herein, the phrase "imaging element" is a material that may be used as a laminated support for the transfer of images to the support by techniques such as ink jet printing or thermal dye transfer, as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver chloroiodide, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1996, Item 38957, Section I, published by Kenneth Mason Publications, Ltd., Dudley Annex, 12a North Street, Emsworth, Hampshire PO107DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

In the following Table, reference will be made to (1) *Research Disclosure*, December 1978, Item 17643, (2) *Research Disclosure*, December 1989, Item 308119, and (3) *Research Disclosure*, September 1996, Item 38957, all published by Kenneth Mason Publications, Ltd., Dudley Annex, 12a North Street, Emsworth, Hampshire PO107DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, | morphology and preparation. |
| | XII, XIV, XV | Emulsion preparation |
| | I, II, III, IX | including hardeners, coating |
| 3 | A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |

-continued

| Reference | Section | Subject Matter |
|---|---|---|
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The laminated substrate of the invention may have copy restriction features incorporated such as disclosed in U.S. application Ser. No. 08/598,785 filed Feb. 8, 1996 and U.S. application Ser. No. 08/598,778 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the backside to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-isible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in *Research Disclosure* 37038 of February 1995.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish was added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 46.5 lbs. per 1000 sq. ft. (ksf) bone dry weight base paper was made on a fourdrinier paper machine, wet pre0ssed to a solid of 42%, and dried to a moisture of 10% using steam-heated dryers achieving a Sheffield Porosity of 160 Sheffield Units and an apparent density 0.70 g/cc. The paper base was then surface sized using a vertical size press with a 10% hydroxyethylated cornstarch solution to achieve a loading of 3.3 wt. % starch. The surface sized support was calendered to an apparent density of 1.04 gm/cc.

The following examples illustrate the practice of this invention. They are not intended to be exhaustive of all possible variations of the invention. Parts and percentages are by weight unless otherwise indicated.

EXAMPLES

Examples 1–11

The following laminated photographic bases in Table I were prepared by extrusion laminating several different biaxially oriented sheets, with and without $TiO_2$ and with and without a HALS, to the emulsion side of the photographic grade cellulose paper base along with one biaxially oriented sheet to the back side of the photographic grade cellulose paper base.

TABLE 1

Oriented Polypropylene Multilayers - Additives[1]

| sample | wt % HALS in L2 | wt % HALS in L3 | wt % $TiO_2$ in L3 |
|---|---|---|---|
| 1 (control) | 0 | 0 | 0 |
| 2 | 0.33 | 0 | 0 |
| 3 | 0.33 | 0.33 | 0 |
| 4 (control) | 0 | 0 | 1 |
| 5 | 0.33 | 0 | 1 |
| 6 | 0 | 0.33 | 1 |
| 7 | 0.33 | 0.33 | 1 |
| 8 (control) | 0 | 0 | 4 |
| 9 | 0.33 | 0 | 4 |
| 10 | 0 | 0.33 | 4 |
| 11 | 0.33 | 0.33 | 4 |
| control[2] (control) | 0 | 0 | 0 |

[1]All samples contain ~0.15% Irganox 1010 and ~0.15% Irgafos 168 in all layers, and 18% $TiO_2$ in layer 2 (L2).
[2]Same as [1] but does not have any $TiO_2$ in any layer. Used only for loss in molecular weight testing.

As referred to in these examples:

HALS (Hindered amine) is poly{[6-[(1,1,3,3-tetramethylbutyl)amino]-1,3,5-triazine2,4-diyl][(2,2,6,6-tetramethyl-4-piperidinyl)imino]-1,6-hexanediyl[(2,2,6,6-tetramethyl-4-piperidinyl)imino]] (Chimassorb 944 LD/FL).

Irganox 1010 is the preferred prior art phenolic based material [3,5-bis(1,1-dimethylethyl)-4-hydroxy-, 2,2-bis[[3-[3,5-bis(1,1-dimethylethyl)-4-hydroxyphenyl]-1-oxopropoxy]methyl]-1,3-propanediyl ester.

Irgafos 168 is the preferred phosphite materials is 2,4-bis (1,1-dimethylethyl) phosphite.

$TiO_2$ is a rutile form manufactured by DuPont (Type: R-104).

PP is polypropylene.

LDPE is low density polyethylene.

The following sheet was laminated to a photographic grade cellulose paper base:

Bottom sheet: (backside)

BICOR 70 MLT (Mobil Chemical Co.), a one-side matte finish, one-side treated biaxially oriented polypropylene sheet (18 mm thick) (d=0.9 g/cc) consisting of a solid oriented polypropylene core and a skin layer of a mixture of polyethylenes and a terpolymer of ethylene-propylene-butylene with a orientation ratio of 5:8. Polypropylene core side was laminated to the cellulose paper exposing the skin layer of block copolymer.

The following sheets were then laminated to the face side (image side) of the photographic grade cellulose paper base creating a white imaging base.

Top Side: (image side)

A modified form of OPPalyte 310 HSTW which is a biaxially oriented polypropylene film of 1.5 mils thickness containing a thin skin layer of polyethylene (L1), a layer of polypropylene that contains a 18% $TiO_2$(L2), a voided core of polypropylene (L3), and a solid layer of a homopolymer of polypropylene. A hindered phenol and an aryl phosphite are present in the biaxially oriented polypropylene film at concentrations of 0.15–0.3% of each stabilizer. A hindered amine in the amount of 0.33% by weight of the polymer layer was added to various layers (L2 or L3—See Table 1) of the sheet structure while adjusting the amount of $TiO_2$ in the voided layer from 0 to 4%. The photographic bases in Table I were prepared by melt extrusion lamination using 1924P low density polyethylene (Eastman Chemical Co.) (extrusion grade with a density of 0.923 g/cm$^3$ and a melt index of 4.2) as the bonding layer. Both the top sheet and bottom sheet were laminated to a photographic grade cellulose paper.

| Laminated Photo Base Structure with Emulsion |
|---|
| Photographic emulsion layers |
| L1 is a 0.8 micron layer of LDPE |
| L2 is 5 micron layer of PP containing 18% TiO2 |
| L3 is a voided layer of PP |
| L4 is a 5 micron layer of PP |
| L5 is a solid layer of PP |
| LDPE Bonding layer |
| Photo Paper base |
| LDPE Bonding Layer |
| 70 MLT |

* All samples contain ~0.15% Irganox 1010 and ~0.15% Irgafos 168 in all layers, and 18% $TiO_2$ in layer 2.
HALS and $TiO_2$ are varied in L2 and L3 per Table 1

The composite laminated sheet was then coated with a silver halide photographic emulsion in Coating Format 1. Samples submitted for loss in molecular weight were processed D-mins (Clear) with no image residual silver or dyes to allow the light unobstructured access to the base polymers under the emulsion and to better simulate a photograph during the high temperature/humidity light testing. When the actual loss in molecular weight testing was run, the emulsion layer was removed with a 10% solution of bleach. The bleach solution was applied and then allowed to swell the emulsion for approximately 5 minutes, and then a clean cloth was rubbed across the surface to remove the emulsion. The surface was rinsed several times to assure complete removal prior to testing.

| | Coating Format 1 | Laydown mg/m$^2$ |
|---|---|---|
| Layer 1 | Blue Sensitive Layer | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |

-continued

| Coating Format 1 | Laydown mg/m$^2$ |
|---|---|
| UV-2 | 235 |
| S-4 | 30 |
| SC-1 | 3 |
| Layer 6 UV Overcoat | |
| Gelatin | 440 |
| UV-1 | 20 |
| UV-2 | 110 |
| SC-1 | 30 |
| S-3 | 20 |
| S-1 | 20 |
| Layer 7 SOC | |
| Gelatin | 490 |
| SC-1 | 17 |
| $SiO_2$ | 200 |
| Surfactant | 2 |

APPENDIX

Y-1

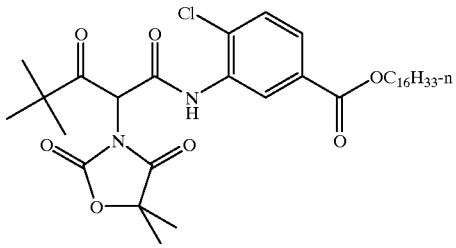

ST-1 = N-tert-butylacrylamide/n-butyl acrylate copolymer (50:50)

S-1 = dibutyl phthalate

SC-1

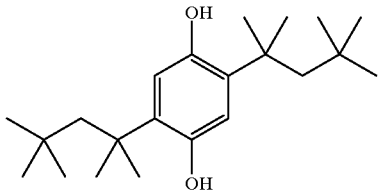

M-1

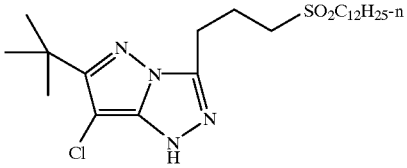

S-2 = diundecyl phthalate

ST-2

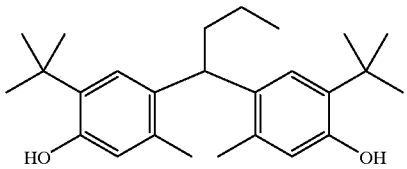

ST-3

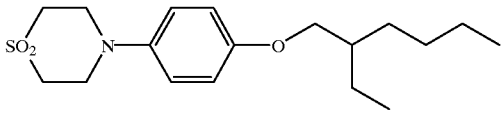

-continued

ST-4

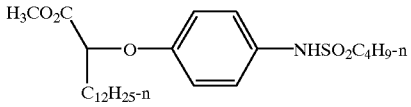

UV-1

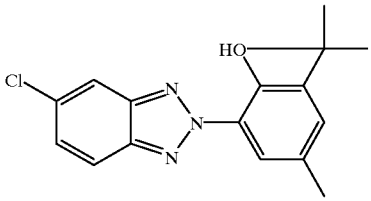

UV-2

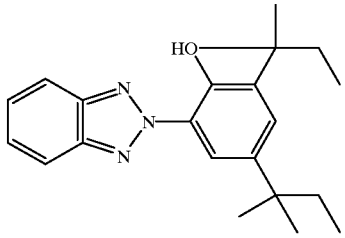

S-3 = 1,4-Cyclohexyldimethylene bis(2-ethylhexanoate)

C-1

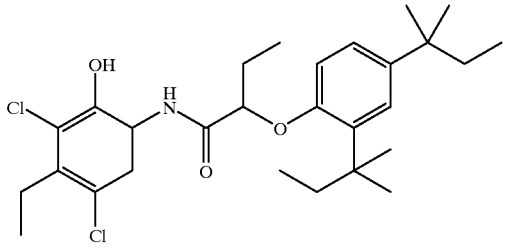

S-4 = 2-(2-Butoxyethoxy)ethyl acetate

Dye 1

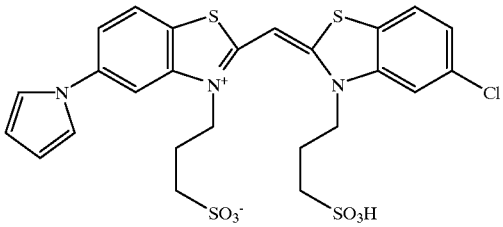

Samples without a photographic emulsion were exposed to 1000 ppm of oxides of nitrogen, generated from the acidification of sodium nitrate, in a glass desiccator shielded from light. Spectrogard colorimetry was obtained using the total spectrum range (UV in) and with ultraviolet irradiation filtered out (UV out). Measurements were read in CIELAB units (Y, X, Z, sx, sy, sz, L*, a*, b* and whiteness) with the samples backed by black paper. Results are given in Table 2.

Examples for Mono Layer of polypropylene

Comparison monolayer coatings Samples 12–14 on paper of unoriented polypropylene containing 18% rutile $TiO_2$ and various combinations of Irganox 1010 phenolic, Irgafos 168 aryl phosphite and Chimassorb 944 LD/FL HALS are used for a baseline. The monolayer coatings are approximately 1 mil thick, prepared by extrusion coating onto the same paper support used for laminate films. This set of samples was not emulsion coated.

A polypropylene monolayer containing no stabilizers exhibits a shift in b* (0.51, Table 2, first entry under monolayers Example 12) that is considered a "baseline" discoloration of the polypropylene matrix and pigment, unassociated with gas yellowing of phenolic antioxidant. An increase in b* is observed with 0.15% Irganox 1010 and 0.15% Irgafos 168, (Table 2, 2nd entry under monolayer Example 13). Discoloration is much worse with phenolic, aryl phosphite and HALS together (Table 2, 3rd entry under monolayers Example 14), and the spectrum of the discolored products shifts from yellow to longer wavelengths. There is a corresponding large decrease in whiteness.

TABLE 2

Spectrogard Colorimetry[1]
Nine day $NO_x$ Exposure, 1000 ppm
Laminated to Paper

| Sample # | initial b* | $NO_x$ exposed Δb* | initial white-ness | $NO_x$ exposed Δwhite-ness |
|---|---|---|---|---|
| Monolayers (controls) | | | | |
| 12 PP[2], no stabilizers | 0.68 | 0.55 | 88.09 | −1.81 |
| 13 PP 0.15% each Irganox 1010, Irgafos 168 | 0.60 | 1.15 | 86.83 | −5.11 |
| 14 PP 0.15% each Irganox 1010, Irgafos 168, Chimassorb 944 LD/FL | 0.58 | 4.18 | 88.44 | −24.63 |
| multilayers(Reference Table 1 for chemistry type, level and location) | | | | |
| 1 (control) | 0.15 | 1.17 | 89.19 | −4.59 |
| 2 | 0.12 | 1.01 | 89.14 | −4.00 |
| 3 | 0.15 | 1.61 | 87.88 | −7.99 |
| 4 (control) | 0.12 | 1.04 | 89.45 | −4.39 |
| 5 | 0.12 | 1.00 | 89.36 | −4.17 |
| 6 | 0.14 | 1.30 | 88.50 | −6.70 |
| 7 | 0.15 | 1.28 | 88.89 | −6.56 |
| 8 (control) | 0.16 | 0.87 | 89.43 | −3.51 |
| 9 | 0.21 | 0.82 | 89.32 | −3.64 |
| 10 | 0.15 | 1.13 | 89.06 | −5.90 |
| 11 | 0.16 | 1.12 | 89.06 | −5.86 |

[1]Backed by black, UV out
[2]Unoriented polypropylene monolayer containing 18% R-104 $TiO_2$, coated on paper.

In contrast, multilayers containing various combinations of phenolic (Irganox 1010), aryl phosphite (Irgafos 168) and HALS (Chimassorb 944 LD/FL) as represented by invention samples 2, 3, 5, 6, 7, 9, 10 and 11, all exhibit much smaller shifts in b* and whiteness than a monolayer of polypropylene as is represented by control sample 14 (samples containing equal amounts of the three stabilizers). We thus find an unexpected and unobvious result: The resistance to atmospheric gas yellowing of phenolic antioxidants such as Inganox 1010, in combination with HALS such as Chimassorb 944, is superior in polyethylene/polypropylene multilayer formats compared to polypropylene monolayers. The advantage of a hindered amine light stabilizer in a biaxially oriented multilayer sheet is further indicated by Table 3 in which very significant improvements are made in the retardation of molecular weight loss within the polymer sheet. Stability of the imaging element and the image are major features required for the commerical use of imaging elements.

The molecular weight of polyolefin components after exposure to 100 footcandle continuous illumination for 89 days at 80° C. is provided in Table 3. Lower $M_n$ and $M_w$ number indicates loss in molecular weight of the polymer after light exposure.

TABLE 3

Multilayer Layer Molecular Weight
100 footcandles, 80° C., 89 days

| sample | $M_n$[1] | $M_w$[2] |
|---|---|---|
| average (all samples), 0 days | 43500 ± 5400 | 321000 ± 9000 |
| 1 (control) | 23000 | 263000 |
| 2 | 30400 | 277000 |
| 3 | 31100 | 310000 |
| 4 (control) | 4640 | 20900 |
| 5 | 9500 | 50400 |
| 6 | 27700 | 296000 |
| 7 | 27100 | 290000 |
| 8 (control) | 4400 | 12800 |
| 9 | 3840 | 15600 |
| 10 | 20900 | 249600 |
| 11 | 28300 | 273000 |
| Control (Clear PP/No $TiO_2$) | 42550 | 317300 |

[1]Polystyrene equivalent number average molecular weight
[2]Polystyrene equivalent weight average molecular weight A baseline of number and weight average molecular weight is shown as the top entry in Table 3. This indicates the starting molecular weight prior to any exposure to light. The control sample is clear polypropylene with no $TiO_2$ in any layer, but it does contain a phenolic and aryl phosphite antioxidant as is present in all of these samples. There is very little loss in molecular weight from the baseline molecular weight with no light exposure. Sample 1 does not contain HALS but has 18% $TiO_2$ in L2 and no $TiO_2$ in the voided L3 layer. As can be seen from Table 3, polypropylene will degrade in molecular weight with light exposure when $TiO_2$ is present. Samples 2 and 3 have HALS added L2 and in both L2 and L3 respectively. The data show that the addition of HALS has a positive impact in reducing molecular weight loss. Sample 4 contains no HALS, but 1% $TiO_2$ is added to the voided layer (L3). The data show a severe loss in molecular weight when pigment is added to a voided polymer structure. Even when HALS is added to L2 (solid layer of polypropylene with 18% $TiO_2$) and there is $TiO_2$ in the voided layer, there is still a significant loss in molecular weight as indicated by sample 5. In sample 6 HALS is added only to L3 which also contains voids and $TiO_2$. As can be seen with this data, the molecular weight loss reduction is greatly improved. Sample 7 is the same as sample 6 except that HALS is added to both L2 and L3. The data show no addition improvement in reducing molecular weight loss. Samples 8–11 are similar to samples 4–7 except that 4% $TiO_2$ is added to the voided L3 layer vs. 1% $TiO_2$. It can be seen that with higher levels of $TiO_2$ in L3 without HALS, the amount of molecular weight reduction is increased (sample 4 vs. sample 8). Samples containing no HALS (samples 4 and 8) have unacceptable light stability, and exhibit a large decrease in molecular weight with light exposure, leading to embrittlement and cracking. Samples containing HALS in L2 (samples 5 and 9) are marginally more stable than samples containing no HALS (samples 4 and 8), but also show substantial loss of molecular weight and physical properties.

The data teach us:

1. Photooxidative degradation of polyolefin components occurs primarily in layers that contain $TiO_2$ as shown by comparing the starting point molecular weight average and control (without $TiO_2$) and samples 1–3 against samples 4–11.

2. The voided layer (L3) is the layer most susceptible to photooxidative degradation, and the stability of the voided layer (L3) decreases with increasing $TiO_2$ concentration, between zero and four weight percent. Acceptable photostability of voided layers containing $TiO_2$ can only be obtained with HALS present in L3. This is evident by comparing samples 4 and 8 which contains 1 and 4% $TiO_2$ respectively against samples 6 and 10 that have HALS added to the L3 layer.

3. HALS improves photooxidative stability wherever it is incorporated; however, it is most effective when incorporated in the voided layer. The L3 is the core layer and is the thickest layer and thus provides the highest total mass of HALS in the multilayer film.

The invention has been described in detail with particular reference to certain preferred embodiments thereof, but it will be understood that variations and modifications can be effected within the spirit and scope of the invention.

What is claimed is:

1. A laminated base for an imaging element comprising a paper having adhered to each side a biaxially oriented sheet of polyolefin polymer, wherein the top biaxially oriented sheet on the image side has incorporated therein a stabilizing amount of hindered amine light wherein the top biaxially oriented polyolefin sheet contains a plurality of layers of polypropylene and at least one of said layers comprises voids, at least one of the layers comprises polypropylene polymer, $TiO_2$, hindered amine light stabilizer, and hindered phenol and at least one layer comprising a hindered amine light stabilizer and a stabilizing amount of a hindered phenol further comprises a secondary phosphate antioxidant.

2. The base of claim 1 wherein the biaxially oriented polyolefin sheet comprises a plurality of layers of which at least two layers comprise at least one pigment selected from the group consisting of: $TiO_2$, $CaCO_3$, Clay, $BaSO_4$, ZnS, ZnO, $MgCO_3$, Talc, and Kaolin.

3. The base of claim 1 wherein at least two layers of the top biaxially oriented sheet contain the hindered amine light stabilizer in an amount between 0.01 and 5% by weight.

4. The element of claim 1 wherein the said hindered amine is selected from the group consisting of poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]} pentaerythrityl tetrakis [3-(3,5-di-tert-butyl-4-hydroxyphenyl)proprionate], and 2,4-bis(1,1-dimethylphenyl) phosphite.

5. An imaging element comprising at least one upper image forming layer carried on a laminated base comprising a paper having adhered to each side a biaxially oriented sheet of polyolefin polymer, wherein the upper biaxially oriented sheet has incorporated therein a stabilizing amount of hindered amine wherein the top biaxially oriented polyolefin sheet contains a plurality of layers of polypropylene polymer and at least one of said layers comprises voids, and at least one of the layers comprises polypropylene polymer, $TiO_2$, hindered amine light stabilizer, hindered phenol stabilizer, and a secondary phosphite antioxidant.

6. The element of claim 5 wherein said upper biaxially oriented polyolefin sheet comprises a plurality of layers wherein at least two layers comprise at least one pigment selected from the group consisting of: $TiO_2$, $CaCO_3$, Clay, $BaSO_4$, ZnS, ZnO, $MgCO_3$, Talc, and Kaolin.

7. The element of claim 6 wherein said top biaxially oriented sheet comprises a hindered amine light stabilizer in an amount between 0.01 to 5% by weight of the layer.

8. The element of claim 5 wherein the said hindered amine is selected from the group consisting of poly{[6-[(1,1,3,3-tetramethylbutylamino}-1,3,5-triazine-4-piperidinyl)-imino]-1,6-hexanediyl[(2,2,6,6-tetramethyl-4-piperdinyl) imino]}, pentaerythrityl tetrakis [3-(3,5-di-tert-butyl-4-hydroxyphenyl)proprionate], and 2,4-bis(1,1-dimethylphenyl) phosphite (Irgafos 168).

9. The element of claim 5 wherein said image forming layer comprises photosensitive silver halide and dye forming coupler.

10. The element of claim 5 wherein said image forming layer comprises an image receiving layer to which an image may be transferred.

11. The element of claim 10 wherein said image receiving layer comprises at least one material selected from the group consisting of gelatin, polyvinyl pyrrolidine, starch, and methacrylate.

* * * * *